US006971974B2

(12) United States Patent
Bowman et al.

(10) Patent No.: US 6,971,974 B2
(45) Date of Patent: Dec. 6, 2005

(54) QUICK RELEASE RATCHETING APPARATUS FOR A WEIGHT LIFT BAR SYSTEM

(76) Inventors: Maryellen Bowman, 1241 North Ave., Apartment #2, Highland Park, IL (US) 60035; Joseph H. Bowman, Jr., 37199 N. Twin Oaks Dr., Lake Villa, IL (US) 60046; Aaron Eiger, 3704 N. Bosworth Ave., Apartment #2, Chicago, IL (US) 60613; Julie Lipkin Green, 811 Chicago Ave., Apartment #508, Chicago, IL (US) 60202

( * ) Notice: Subject to any disclaimer, the term of this patent is extended or adjusted under 35 U.S.C. 154(b) by 572 days.

(21) Appl. No.: 10/064,153

(22) Filed: Jun. 14, 2002

(65) Prior Publication Data

US 2003/0232704 A1 Dec. 18, 2003

(51) Int. Cl.[7] ..... A63B 21/072
(52) U.S. Cl. ..... 482/107; 482/106
(58) Field of Search ..... 482/98, 104, 106–109; D21/681, 682, 680; 16/DIG. 8

(56) References Cited

U.S. PATENT DOCUMENTS

| | | | | | |
|---|---|---|---|---|---|
| 353,089 | A | * | 11/1886 | Smith | 482/102 |
| 1,316,683 | A | * | 9/1919 | Calvert | 482/93 |
| 4,076,236 | A | * | 2/1978 | Ionel | 482/108 |
| 4,361,324 | A | * | 11/1982 | Baroi | 482/108 |
| 4,529,197 | A | | 7/1985 | Gogarty | |
| 4,529,198 | A | * | 7/1985 | Hettick, Jr. | 482/104 |
| 4,569,105 | A | | 2/1986 | Weider | |
| 4,585,367 | A | | 4/1986 | Gall | |
| 4,638,994 | A | | 1/1987 | Gogarty | |
| 4,646,398 | A | | 3/1987 | Myhrman | |
| 4,738,446 | A | | 4/1988 | Miles | |
| 4,773,641 | A | | 9/1988 | Metz | |
| 4,817,944 | A | | 4/1989 | Anderson et al. | |
| 4,893,810 | A | | 1/1990 | Lee | |
| 4,948,123 | A | | 8/1990 | Schook | |
| 4,955,603 | A | | 9/1990 | Becker | |
| 4,971,318 | A | | 11/1990 | Tracy | |
| 5,062,631 | A | | 11/1991 | Dau et al. | |
| 5,123,885 | A | | 6/1992 | Shields | |
| 5,158,517 | A | * | 10/1992 | Steggert | 482/98 |
| 5,163,887 | A | | 11/1992 | Hatch | |

(Continued)

FOREIGN PATENT DOCUMENTS

FR 2600541 A1 * 12/1987 ..... A63B 11/02

OTHER PUBLICATIONS

German publication dated Dec. 1983-"Ellipsen-Hantel-fur Mannerfauste massgeschneidert!", pp. 76, 77, 96, 104, 105.*

(Continued)

*Primary Examiner*—Jerome W. Donnelly
*Assistant Examiner*—Victor K. Hwang

(57) ABSTRACT

A quick-release ratcheting mechanism for a weight lifting bar system. The present invention utilizes a ratcheting device in conjunction with ratchet teeth which are located on the inside surface of an aperture of individual weight components. As such, when the individual weight components are placed onto the present invention, the present invention ratcheting system engages the weight component teeth, subsequently creating a fixed and secure engagement. If the user desires to remove the individual weight component, a quick-release handle disengages the ratchet mechanism and allows free removal of an individual weight component. As a further feature the present invention, the preferred embodiment incorporates a unique passive interlocking means between each adjacently placed individual weight component and a unique geometric configuration which enhances the stability of the present invention.

8 Claims, 2 Drawing Sheets

U.S. PATENT DOCUMENTS

| | | | | | |
|---|---|---|---|---|---|
| 5,171,199 | A | | 12/1992 | Panagos | |
| 5,295,933 | A | | 3/1994 | Ciminski et al. | |
| 5,346,449 | A | | 9/1994 | Schlagel | |
| 5,421,797 | A | * | 6/1995 | Fletcher | 482/106 |
| 5,449,333 | A | | 9/1995 | Carter | |
| 5,484,367 | A | * | 1/1996 | Martinez | 482/107 |
| 5,591,109 | A | | 1/1997 | Strnad | |
| 5,603,680 | A | | 2/1997 | Larsen | |
| 5,605,411 | A | | 2/1997 | Wilson et al. | |
| 5,879,274 | A | | 3/1999 | Mattox | |
| 5,911,651 | A | | 6/1999 | Liu | |
| 6,007,268 | A | | 12/1999 | Whittington et al. | |
| 6,010,436 | A | | 1/2000 | Obery et al. | |
| 6,039,678 | A | | 3/2000 | Dawson | |
| 6,059,700 | A | | 5/2000 | Ellenburg | |
| 6,500,101 | B1 | * | 12/2002 | Chen | 482/107 |
| 6,656,093 | B2 | * | 12/2003 | Chen | 482/108 |

OTHER PUBLICATIONS

World Sporting Goods, Inc., All New World Olympic Bar Square or Round Sleeves With the New Safety Locking Collars, advertisement in Coach & Athlete, Mar. 1981, p. 62.*

* cited by examiner

QUICK RELEASE RATCHETING APPARATUS FOR A WEIGHT LIFT BAR SYSTEM

BACKGROUND OF THE INVENTION

The present invention relates generally to weight fitness training equipment. More specifically, the present invention relates to a weight fitness training lifting bar apparatus which facilitates the quick changing and/or release of attached component weights, thus increasing the speed and efficiency at which the lifting bar's individual weight components may be replaced or removed.

Furthermore, not only is the conventional method of a fixedly attached weight collar time consuming, it is also sometimes dangerous. It is all too frequent the case when the weight collar is incorrectly attached on the barbell or dumbbell. As such, inherent with a normal weight training session, the weight set is frequently misaligned from a level horizontal plane and weight forces maintained against the collar assemblies are often great, thus forcing the weight collar assembly off the end of the barbell or dumbbell and without a maintained supporting mechanism, the weight components themselves fall off causing potential harm to the weight training participant due to instantaneous weight imbalances and weight changes, as well as anyone within the immediate vicinity due to loose, and potentially heavy, weight components.

There have been many attempts by others to solve these problems. For example, U.S. Pat. No. 4,893,810 to Lee issued on Jan. 16, 1990 ('810) discloses the use of a quick release collar assembly for a weight lifting barbell. The '810 invention uses a collar body, an axially movable sleeve and a plurality of radially movable balls which are cammed into frictional engagement with the lifting bar. Essentially, the '810 patent relies upon frictionally engaging the collar assembly with the end of the barbell. Furthermore, the '810 patent has the benefit of being quickly disengaged with one-handed operation. However, limitations of the '810 patent include its reliance solely on a frictional engagement between the movable cammed balls located within the interior of the collar assembly and the exterior surface of the barbell to secure the individual weight components. As such, the '810 patent is highly susceptible to being forced off the barbell by the weight components' continual planer adjustments. Furthermore, if there are imperfections within the barbell exterior surfaces, the '810 invention will not create a steadfast connection which is necessary to withstand the weight forces. Also, there is no fast and sure method to ensure that the '810 collar is properly attached and it thus may be susceptible to improper installation. The present invention overcomes such limitations by, for example, creating a positive physical attachment mechanism between the weight components and the barbell and not relying solely on frictional engagement, thus negating the possibility of the weight components falling off. Furthermore, the present invention provides positive feedback to the user through the ratcheting mechanism, as well as easy installation, and thus minimizes any uncertainty as to whether or not the present invention is properly installed.

U.S. Pat. No. 4,948,123, to Schook issued on Aug. 14, 1990 ('123) discloses a weight training apparatus which includes a weight training apparatus with one or more separate weights mounted to each other and to the barbell. Essentially, the '123 patents utilizes a suction device on the ends of the barbell to create an attachment mechanism to ensure that the weight components are maintained on the barbell. However, a limitation of the '123 patent is that the suction device may not be totally reliable. Also, it is time consuming to disengage the locking mechanism every time and thus to place or remove weights from the barbell. The present invention overcomes such limitations by, for example, not relying on physical suction to ensure an accurate and tight locking engagement with the barbell. Also, the present invention promotes easy, quick and efficient removal and installation of individual weight components.

U.S. Pat. No. 4,955,603, to Becker issued on Sep. 11, 1990 ('603) discloses a barbell weight lock apparatus with threaded portions on opposite ends of the barbell. Conventional weights are placed on the barbell, whereupon a conventional barbell collar, with a threaded screw, is securely placed and tightened against the weights. The threaded portions of the barbell allow a user to manually remove the barbell collar without removing the threaded screw, much the same as a conventional nut is rotated. Furthermore, the barbell collar has the option of being quickly removed by loosening the threaded screw, which thus disengages the threaded portions of the barbell. A limitation of the '603 patent is that the process of removing or adding weight components is time consuming and inefficient and does not necessarily negate the need for tools. Furthermore, the '603 invention is prone to be mistakenly pushed off during utilization due to the threaded portions of the barbell. The present invention overcomes such limitations by, for example, providing an apparatus which can be quickly and easily removed without additional tools or unthreading of screw mechanisms. Furthermore, the present invention safely and securely attaches a plurality of weight components without the possibility of a collar accidentally being incorrectly attached.

U.S. Pat. No. 5,062,631, to Dau et al. issued on Nov. 5, 1991 ('631) discloses a barbell clamp apparatus for holding interchangeable weights on the end portion of a barbell wherein the apparatus has a pair of spring-biased pivotal jaws which physically engage pre-determined slot portions on the barbell. However, a limitation of the '631 patent is that the apparatus must be physically engaged within a narrow slot of the barbell, otherwise it is susceptible to being pushed off the barbell, wherein the interchangeable weights are free to fall off. Furthermore, the '631 patent requires considerable manual strength to disengage the clamp apparatus. Also, the '631 invention is limited with the clamping positions which may be maintained due to the requirement of the pre-determined barbell slots. The present invention overcomes such limitations by, for example, negating the need for an outside collar which is susceptible to being pushed off by the interchangeable weights and does not require excessive manual force to disengage the weight locking assembly.

U.S. Pat. No. 5,346,449, to Schlagel issued on Sep. 13, 1994 ('449), discloses a barbell system with an improved locking feature. The '449 invention uses a pair of plunger pieces which are inserted by suction into the ends of a hollow handle of a barbell. The plunger pieces thus hold the interchangeable weights on the barbell using the suction provided within the hollow barbell handle. However, a limitation of the '449 patent is that the suction is not reliable wherein it can easily be depressurized during use, allowing the weights to fall off. The present invention overcomes such limitations by, for example, negating the need for an outside collar and rather relies on mechanical locking interaction rather than error-prone physical suction.

U.S. Pat. No. 5,591,109, to Strnad issued on Jan. 7, 1997 ('109) discloses a quick-release retaining collar assembly for a barbell. The '109 invention utilizes a shoe located within the collar assembly to frictionally engaged the exterior surface of a conventional barbell. The '109 assembly is easily engaged or disengaged by utilizing an attached locking handle. A limitation of the '109 invention is that is relies only on a frictional engagement between the locking collar and the barbell. As such, without a proper and secure frictional engagement, the locking collar is susceptible of sliding off the barbell during use. The present invention overcomes such a limitation by, for example, not relying on a frictional engagement, but rather a positive mechanical locking assembly.

U.S. Pat. No. 5,603,680, to Larsen issued on Feb. 18, 1997 ('680), discloses a locking collar for a dumbbell or barbell. The '680 invention relies solely on the frictional engagement of a grip pad within the locking collar assembly and the exterior surface of the barbell. Once again, a limitation of the '680 invention is its reliance on friction between the locking collar and barbell surface. The present invention overcomes such a limitation by, for example, relying on a mechanical locking mechanism incorporated within the barbell rather than friction.

The present invention overcomes the disadvantages and/or shortcomings of known prior art barbell and/or dumbbell quick-release locking mechanisms and provides significant improvements thereover.

BRIEF SUMMARY OF THE INVENTION

It is an object of the present invention to provide a secure and safe method of fixedly attaching individual weight lifting components to a lifting bar.

It is another object of the present invention to provide a quick and easy method of removing and/or placing individual weights onto a lifting bar.

It is yet another object of the present invention to provide a mechanical locking device to ensure a positive connection is maintained between a lifting bar and the individual weight components.

The present invention is best described as a quick-release apparatus for a weight lifting bar assembly. The present invention preferably uses a mechanical ratchet mechanism that securely attaches keyed individual weight components onto a lifting bar. The individual weight components, constructed of conventional weight component material, such as metals, plastics, and the like, are available in a plurality of different weight classes and sizes, such as 5, 10 or 25 pound weights. The mass of the different weights can very and is essentially limitless.

The present invention incorporates a fixedly attached ratcheting assembly onto both ends of a lifting bar, such as a barbell or dumbbell. The attached ratcheting assembly can also be easily detached from the lifting bar for maintenance, if so required. The present invention invention's ratcheting assembly entails a keyed protrusion member, a ratcheting device and a quick-release mechanism. The ratcheting device is preferably placed within a hollowed portion of the keyed protrusion member, wherein the ratcheting device's engagement teeth are accessible from the outside surface of the protrusion member. The keyed protrusion member preferably maintains a unique geometric configuration, such as triangular, rectangular, and the like, to facilitate easy placement of an individual weight component onto the ratcheting assembly.

The present invention uses a plurality of individual weight components with an aperture located within the center of the weight component with a geometric configuration matching the keyed protrusion member. Furthermore, each aperture maintains a plurality of teeth which readily and actively engage the ratcheting device's engagement teeth when the individual weight components are placed over the keyed protrusion member. As such, any number of weight components can be fixedly and securely attached to the keyed protrusion member, which is fixedly attached to the lifting bar.

A quick-release mechanism allows for quick and easy disengagement of the ratcheting device. As such, when the quick-release mechanism is engaged, the ratcheting device disengages the individual weight components, wherein the individual weight components can be freely removed from the keyed protrusion member.

The present invention thus provides a safe and efficient apparatus to securely attach individual weight components on a weight lifting bar. As such, the present invention does not rely on frictional dynamics, but rather positive mechanical ratcheting principles, wherein the user is ensured that the ratcheting mechanism and weights are properly engaged by the audible mechanics of the ratcheting system. As such, the chances of incorrect placement and subsequent inadvertent failure of the weight component securing system is drastically decreased. Furthermore, the quick release mechanism provides a quick and easy method to safely remove individual weight components without the need for any accessories, such as a screwdriver or wrench.

BRIEF DESCRIPTION OF THE SEVERAL VIEWS OF THE DRAWINGS

Preferred and alternate embodiments of the present invention will be described herein with references to the drawings, where appropriate, wherein.

DETAILED DESCRIPTION OF THE INVENTION

The present invention is best described as a weight lifting bar weight component quick-release locking device. The preferred embodiment of the present invention uses a ratcheting system to securely and efficiently attach a plurality of individual weight components to a weight lifting bar. The present invention can be utilized with a weight lifting barbell or dumbbell configuration.

Figure 1:
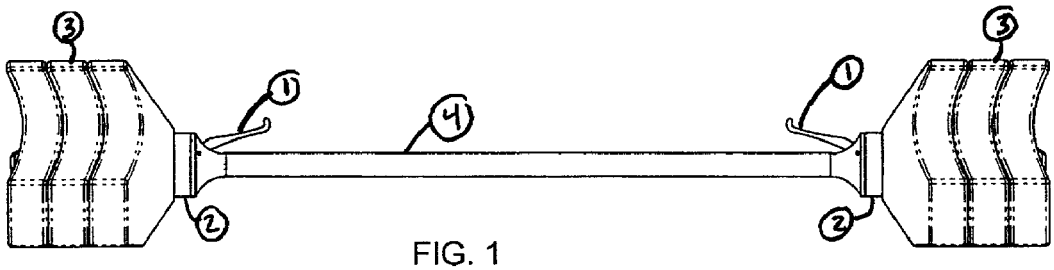
FIG. 1 is a schematic plan view of a fully assembled weight lifting bar with individual weight components engaged with the present invention's locking assembly.
Figure 2:
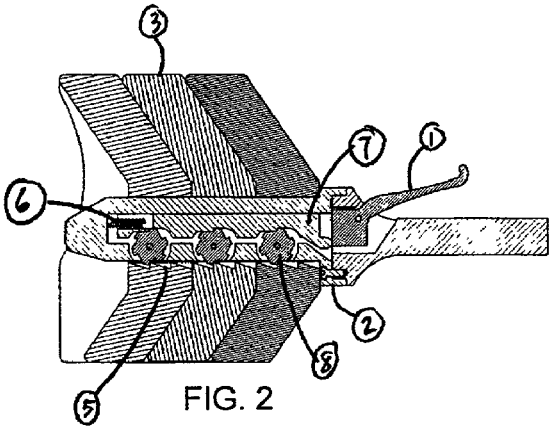
FIG. 2 is a detailed schematic cross-sectional view of the preferred embodiment's ratcheting system depicting the preferred utilization of the quick release mechanism.
Figure 3:
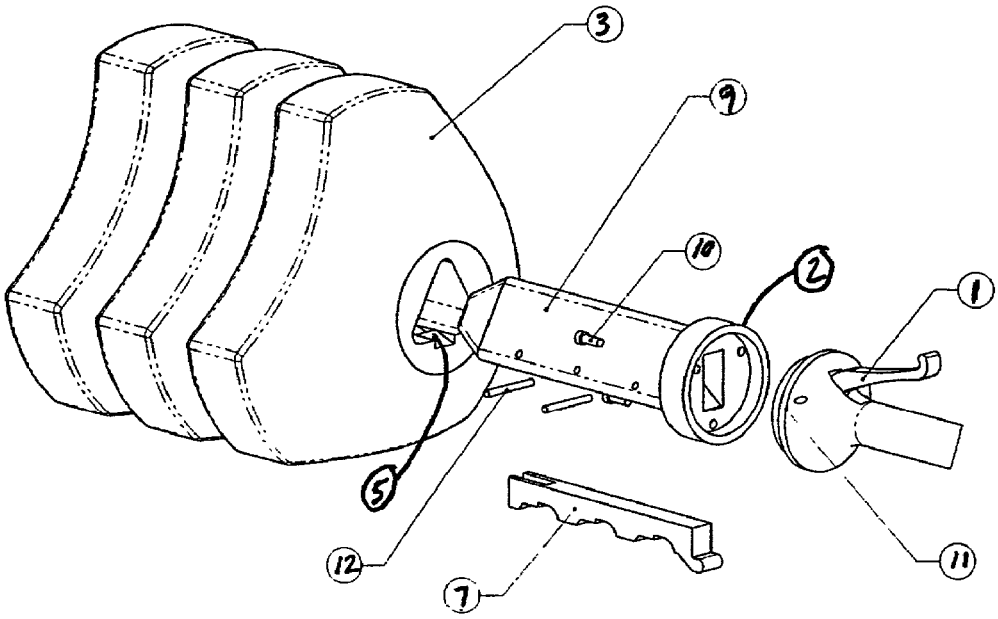
FIG. 3 is a detailed isometric view of the preferred embodiment's ratcheting system in a completely unassembled condition depicting placement and configuration of the preferred embodiment.

Referring to FIGS. 1–3, the preferred embodiment of the present invention utilizes a plurality of individual weight components 3 in conjunction with a weight training lifting bar 4. A quick-release mechanism handle 1 allows quick and easy replacement and removal of the individual weight components 3 when weight modification or removal is desired. A hollow portion and a channel within the keyed protrusion member 9 is used to house an internal ratchet mechanism. As such, when the ratchet mechanism is properly placed within the keyed protrusion member 9, the ratchet teeth of the ratchet mechanism are accessible through a channel located within the keyed protrusion member 9.

Within the preferred embodiment of the present invention, the ratchet mechanism has a ratchet locking member 7 and a plurality of wheel members 8 attached with a rotation means to the hollowed portion of the keyed protrusion member 9 below a recessed area of ratchet locking member 7. The preferred rotation means is a pin device which is preferably placed through a center aperture of the wheel member 8 and is terminally seated within the hollow portion of the keyed protrusion member 9.

The preferred wheel members 8 have a plurality of triangular shaped teeth around the periphery of the wheel members 8. The preferred triangular shaped teeth create an inclined slope which is tangential to the wheel member, and in turn terminates with a plane which is normal to the circle. As such, the preferred wheel members 8, with the preferably triangular shaped teeth, are similar in geometric design to a conventional rotational-type saw blade, such as is conventionally found on a circular saw. As such, when the preferred wheel members 8 are properly attached to the hollowed portion of the keyed protrusion member 9, the teeth of the wheel members 8 are accessible through the channel within the keyed protrusion member 9.

The preferred ratchet locking member 7 recessed areas have at least one protruding portion which engages the wheel members 8. As such, the recessed areas, with the wheel members 8 rotationally attached to the hollowed portion of the keyed protrusion member 9, allow the wheel members 8 to freely rotate omni-directionally, wherein the protruding portion subsequently engages the wheel member 8 saw tooth design and thus prevents rotation in the opposite direction.

Furthermore, within the back end of the hollowed portion of the keyed protrusion member 9 is a spring compression device 6. As such, when no external forces are applied, the ratchet locking member 7 is forced by the spring compression device 6 towards the quick-release mechanism handle 1. Thus, the ratchet locking member 7 has a back end with a compression spring contract point and a front end with a quick-release mechanism handle contact point. When the quick-release mechanism handle, which is preferably pivotally attached to the receiving end 11 of the weight training lifting bar 4, is rotated downward in a lever-like fashion, the quick-release mechanism handle forces the ratchet locking member 7 towards the spring compression device 6, thus compressing the spring compression device 6 and allowing the wheel members 8 to disengage the protruding portion of the ratchet locking member 7. As a result, the wheel members 8 can rotate both clockwise and counterclockwise. When the quick-release mechanism handle 1 is released, the spring compression device 6 forces the ratchet locking member 7 back, thus re-engaging the wheel members 8 with the protruding portion.

The keyed protrusion member 9 is in turn fixedly attached with an attaching means 2 to a receiving end 11, which is fixedly attached to preferably both ends of the weight lifting bar. The preferred attaching means is a threaded screw 10, wherein the keyed protrusion member 9 can be easily removed from the weight lifting bar 4 if maintenance is required. Alternately, other types of attaching means can be effectively utilized.

The keyed protrusion member 9 maintains a unique cross-sectional geometric configuration. The preferred geometric configuration is triangular. Alternately, other types of cross-sectional geometric configurations can be utilized. Further alternately, an additional key type device, such as a unique protrusion along the exterior surface of the keyed protrusion member 9, can be utilized.

Each individual weight component 3 preferably has an aperture with a geometric configuration approximating that of the cross-sectional geometric configuration of the keyed protrusion member 9 which is preferably located within the approximate center of the individual weight component 3. As such, the aperture can readily receive the keyed protrusion member 9 when the keyed protrusion member 9 is placed there through in the predetermined and fixed fashion. Furthermore, the aperture preferably has engaging teeth 5 on at least one internal surface which engages the ratchet mechanism within the keyed protrusion member 9 when the keyed protrusion member 9 is placed through the aperture.

As such, when individual weight components 3 are placed onto the fully assembled keyed protrusion member 9, and since the keyed protrusion member 9 can only be inserted into the individual weight components' 3 aperture one way due to the unique geometric configuration, the ratcheting mechanism within the keyed protrusion member 9 engages the engaging teeth 5 of the individual weight component 3, subsequently fixedly securing the individual weight components 3 to the weight lifting bar 4. When the user desires to remove an individual weight component 3, the user simply depresses the quick-release mechanism level 1, which in turn disengages the ratchet mechanism and allows the individual weight components 3 to be freely removed.

As an enhanced feature of the preferred embodiment of the present invention, the individual weight components 3 have a geometric shape which enhances stabilization and prevents unwanted rotational movement of the individual weight components 3, and ultimately the weight lifting bar 4 as a whole, when the individual weight components 3 are placed on a flat planar surface, such as a floor. The preferred geometric shape of the individual weight components 3 is a polygon, preferably an equilateral triangle.

Furthermore, the preferred embodiment of the present invention incorporates a unique passive interlocking means within each of the individual weight components 3 to further enhance the present invention's objective of providing an improved method of quickly and easily replacing and removing individual weight components from a weight lifting bar. The preferred passive interlocking means uses a protruding geometric configuration on one side of the individual weight component 3, preferably a convex geometric configuration, and a corresponding receiving geometric configuration on the opposite side of the individual weight component 3, preferably a concave geometric configuration, thus resembling a hollowed, conical shape. Alternately, other configurations, such as keyed protrusions extending axially from the individual weight components 3, which in turn are readily received into a keyed protrusion receiving aperture within the adjacent individual weight component 3, can be utilized. As such, when the individual weight components 3 are adjacently placed on the present invention's preferred ratcheting mechanism, the individual weight components 3 abut each other wherein the convex configuration of one individual weight component 3 nests into the adjacent individual weight component's concave configuration. This configuration has the added benefit of providing an enhanced means of ensuring that the individual weight components 3 are properly placed onto the present invention's weight lifting bar while further stabilizing the present invention's individual weight components by preventing unwanted weight shifting.

Figure 4:
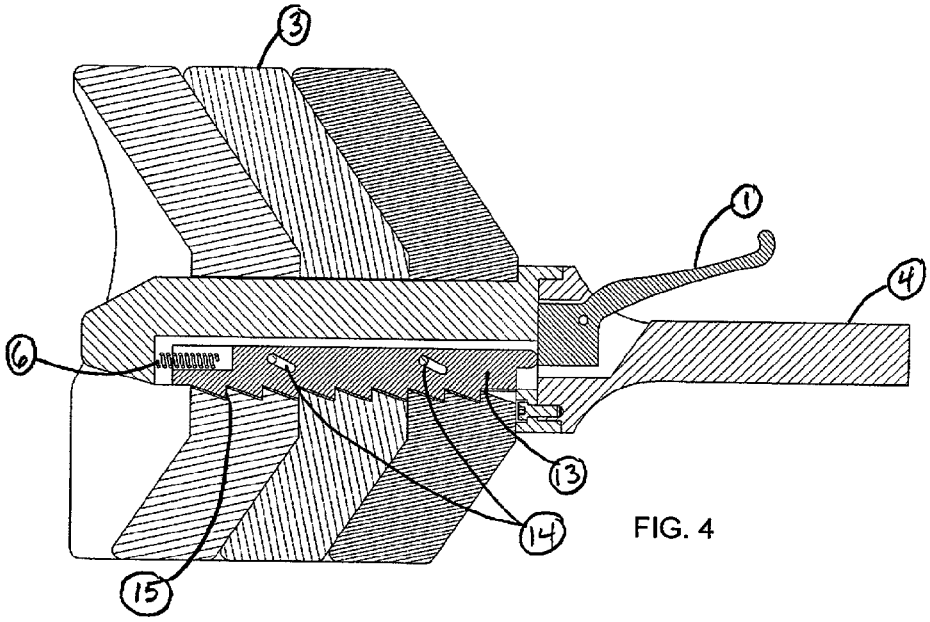
FIG. 4 is a detailed schematic cross-sectional view of the present invention depicting an alternate embodiment of the ratcheting system configuration.
Figure 5:
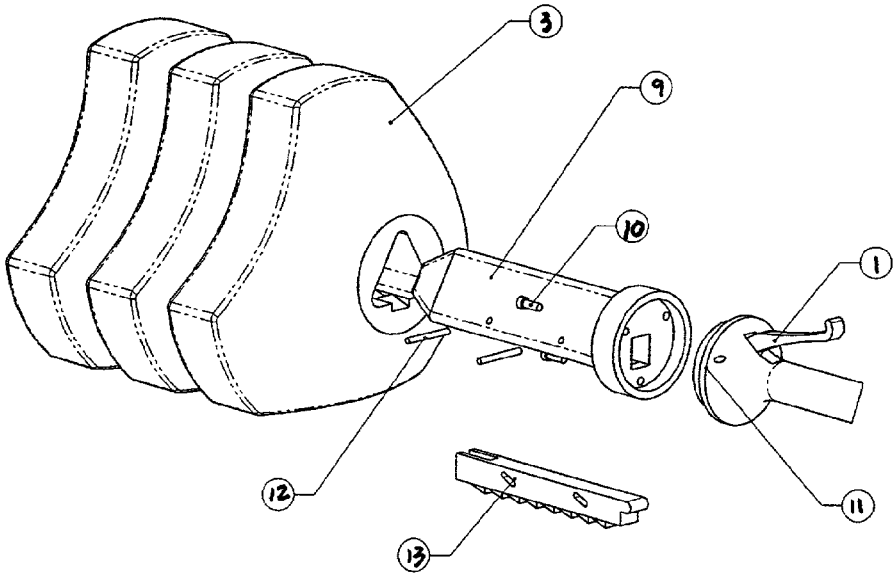
FIG. 5 is a detailed isometric view of the present invention depicting an alternate embodiment of the ratcheting system in a completely unassembled condition.

Referring to FIGS. 4 and 5, an alternate embodiment of the present invention depicts an alternate ratchet mechanism. The alternate ratchet mechanism is an elongated ratcheting member which contains a plurality of teeth-like structures 15 along its bottom edge. The alternate ratchet mechanism is movably attached to the hollowed portion of the keyed protrusion member 9 preferably using a plurality of fixedly mounted pins within an angular slot 14 located within the ratcheting member 13. As such, when the quick-release mechanism handle 1 is depressed, the handle 1 forces the ratcheting member 13 back towards the spring compression device. The angular slots 14 guide the ratcheting member in an upward and backward like manner, as such disengaging the plurality of teeth-like structures 15 from the individual weight components 3 aperture teeth. When the quick-release mechanism handle 1 is released, the spring compression device 6 and the angular slots 14 forces the ratcheting member 13 forward and downward, thus re-engaging the teeth within the individual weight components 3 aperture teeth.

While preferred and alternate embodiments have been described herein, it is to be understood that these descriptions are only illustrative and are thus exemplifications of the present invention and shall not be construed as limiting. It is to be expected that others will contemplate differences, which, while different from the foregoing description, do not depart from the true spirit and scope of the present invention herein described and claimed.

What is claimed is:

1. A quick-release mechanism apparatus for a weight lifting bar, said weight lifting bar having at least two ends, said apparatus comprising: a receiving end, said receiving end being fixedly attached to said end of said weight lifting bar; a keyed protrusion member, said keyed protrusion member having a geometric cross-section, a hollowed portion therein, a channel, a front end and a back end, said hollowed portion having a hollowed back end and a hollowed front end, said front end being fixedly attached to said receiving end with an attachment means; a plurality of individual weight components, said individual weight components having an aperture located approximately in the center thereof, said aperture having a geometric configuration approximately the same as said geometric cross-section and a plurality of aperture teeth on at least one internal surface, wherein said aperture can readily receive said keyed protrusion member; a quick-release handle, said quick-release handle being pivotally mounted within said receiving end; and a ratchet mechanism, said ratchet mechanism being attached to said hollowed portion of said keyed protrusion member.

2. An apparatus as claimed in claim 1 wherein said attachment means is a threaded screw.

3. An apparatus as claimed in claim 1 wherein said geometric cross-section is triangular.

4. An apparatus as claimed in claim 1 wherein said keyed protrusion member further comprises a unique protrusion extending from the exterior surface of said keyed protrusion member.

5. An apparatus as claimed in claim 1 wherein said quick-release handle is a lever.

6. An apparatus as claimed in claim 1 wherein said hollowed portion comprises at least one compression spring fixedly attached to said hollowed back end.

7. An apparatus as claimed in claim 1 wherein said ratchet mechanism comprises, in combination: a plurality of wheel members, said wheel members having a plurality of teeth-like structures on the periphery of said wheel members, said wheel members being rotatably attached to said hollowed portion whereby said teeth-like structures are accessible from the outside of said hollowed portion through said channel when said wheel members are attached thereto and further engage said aperture teeth when said individual weight components are placed over said keyed protrusion member; and a ratchet locking device, said ratchet locking device having a front end, a back end and a plurality of recessed areas to readily receive said wheel members, said front end having a quick-release handle contact point, said back end having a compression spring contact point, said recessed areas having at least one protrusion protruding toward said wheel member whereby said protrusion engages said teeth-like structures when said ratchet locking device is engaged and said wheel members can only rotate in one direction.

8. An apparatus as claimed in claim 1 wherein said ratchet mechanism comprises a ratcheting member, said ratcheting member having a top side, a bottom side, a front end and a back end, said top side having a plurality of angled slots to readily receive attachment pins, said back end having a compression spring contact point, said front end having a quick-release handle contact point, said bottom side having a plurality of teeth whereby when said ratcheting member is attached to said hollowed portion, said teeth are accessible through said channel.

* * * * *